US011214031B2

(12) United States Patent
Dong

(10) Patent No.: US 11,214,031 B2
(45) Date of Patent: Jan. 4, 2022

(54) OIL HYDRAULIC PRESS

(71) Applicants: NINGBO DEMA INTELLIGENT MACHINERY CO., LTD., Ningbo (CN); Xiangyi Dong, Ningbo (CN)

(72) Inventor: Xiangyi Dong, Ningbo (CN)

(73) Assignees: NINGBO DEMA INTELLIGENT MACHINERY CO., LTD., Ningbo (CN); XIANGYI Dong, Ningbo (CN)

( * ) Notice: Subject to any disclaimer, the term of this patent is extended or adjusted under 35 U.S.C. 154(b) by 305 days.

(21) Appl. No.: 16/543,538

(22) Filed: Aug. 17, 2019

(65) Prior Publication Data

US 2019/0366670 A1 Dec. 5, 2019

Related U.S. Application Data

(63) Continuation of application No. PCT/CN2018/108279, filed on Sep. 28, 2018.

(30) Foreign Application Priority Data

Jan. 3, 2018 (CN) ..... 201810005642.9
Mar. 1, 2018 (CN) ..... 201820007399.X
(Continued)

(51) Int. Cl.
*B30B 1/32* (2006.01)
*B30B 15/00* (2006.01)
(Continued)

(52) U.S. Cl.
CPC ..... *B30B 15/0052* (2013.01); *B30B 1/32* (2013.01); *B30B 7/04* (2013.01); *B30B 15/026* (2013.01); *B30B 15/04* (2013.01)

(58) Field of Classification Search
CPC .... B30B 1/32; B30B 7/02; B30B 7/04; B30B 15/0052; B30B 15/026; B30B 15/04;
(Continued)

(56) References Cited

U.S. PATENT DOCUMENTS 3,172,156 A * 3/1965 Belden ..... B30B 15/04 425/78
3,450,035 A * 6/1969 Chapman ..... B30B 15/04 100/214
(Continued)

FOREIGN PATENT DOCUMENTS

CN 1736625 A 2/2006
CN 205467521 U 8/2016
(Continued)

OTHER PUBLICATIONS

International Search Report of PCT/CN2018/108279.
EPO OA—dated Jun. 14, 2021.

*Primary Examiner* — Jimmy T Nguyen

(57) ABSTRACT

The present disclosure provides an oil hydraulic press including a support frame, at least one main cylinder assembly and at least one fixed die table. The at least one main cylinder assembly and the at least one fixed die table are disposed in the support frame. A pressing mechanism is formed between the at least one main cylinder assembly and the at least one fixed die table. The support frame is in an annular or ring-like shape and is configured for fixing the at
(Continued)

least one main cylinder assembly and the at least one fixed die table. The main cylinder assembly and the fixed die table can be fixed by the support frame, which forms a ring-like structure, can be operated in one, two or multiple sets in parallel, and all can realize pressing manufacture. The oil hydraulic press has less components, reduced material consumption and low manufacturing cost.

3 Claims, 9 Drawing Sheets

(30) Foreign Application Priority Data

| | | |
|---|---|---|
| Mar. 18, 2018 | (CN) | 201810221695.4 |
| Mar. 18, 2018 | (CN) | 201810221701.6 |
| Mar. 18, 2018 | (CN) | 201810221706.9 |
| Mar. 18, 2018 | (CN) | 201820363924.1 |
| Mar. 18, 2018 | (CN) | 201820363934.5 |
| Mar. 18, 2018 | (CN) | 201820363937.9 |

(51) Int. Cl.

| | |
|---|---|
| ***B30B 15/02*** | (2006.01) |
| ***B30B 15/04*** | (2006.01) |
| ***B30B 7/04*** | (2006.01) |

(58) Field of Classification Search
CPC ..... B30B 15/047; F15B 7/003; F15B 7/08; F15B 15/1409
See application file for complete search history.

(56) References Cited

U.S. PATENT DOCUMENTS

| | | | | |
|---|---|---|---|---|
| 3,919,878 | A | 11/1975 | Grogs et al. | |
| 5,145,353 | A * | 9/1992 | Zakich | B29C 45/6771 425/588 |
| 2004/0065137 | A1 | 4/2004 | Hellgren | |

FOREIGN PATENT DOCUMENTS

| | | | | |
|---|---|---|---|---|
| CN | 206426490 | U | 8/2017 | |
| CN | 107379601 | A | 11/2017 | |
| CN | 108019591 | A | 5/2018 | |
| CN | 108297477 | A | 7/2018 | |
| CN | 108312607 | A | 7/2018 | |
| CN | 108327331 | A | 7/2018 | |
| DE | 19747658 | A1 | 5/1999 | |
| DE | 102005048648 | B3 | 11/2006 | |
| DE | 102010031100 | A1 | 2/2011 | |
| JP | S56175199 | U | 12/1981 | |
| JP | 2001107911 | A | 4/2001 | |
| WO | WO-2019015609 | A1 * | 1/2019 | B30B 7/02 |

* cited by examiner

OIL HYDRAULIC PRESS

CROSS-REFERENCE TO RELATED APPLICATIONS

This application is a continuation of PCT patent application PCT/CN2018/108279 filed on Sep. 28, 2018, which claims all benefits accruing under 35 U.S.C. § 119 from China Patent Application Nos. 201810005642.9, filed on Jan. 3, 2018, 201810221695.4, filed on Mar. 18, 2018, 201810221701.6, filed on Mar. 18, 2018, 201810221706.9, filed on Mar. 18, 2018, 201820007399.X, filed on Jan. 3, 2018, 201820363924.1, filed on Mar. 18, 2018, 201820363934.5, filed on Mar. 18, 2018, 201820363937.9, filed on Mar. 18, 2018, in the China National Intellectual Property Administration, the content of which is hereby incorporated by reference.

TECHNICAL FIELD

The present disclosure relates to the field of pressure forming technology, and in particular, to an oil hydraulic press.

BACKGROUND

An oil hydraulic press is a molding machine configured for manufacturing industrial products by pressure and widely applied in the engineering field. In the prior art, the oil hydraulic press used in the production cannot flexibly adapt to the demand and the flexibility in the production process. In addition, the oil hydraulic press has a complicated structure and large material consumption, resulting in high cost.

SUMMARY

The present disclosure provides an oil hydraulic press that can form a ring-like structure. The oil hydraulic press can be operated in one, two or multiple sets in parallel with less components, reduced material consumption and low manufacturing cost.

The present disclosure provides an oil hydraulic press including a support frame, at least one main cylinder assembly and at least one fixed die table. The at least one main cylinder assembly and the at least one fixed die table can be disposed in the support frame. A pressing mechanism can be formed between the at least one main cylinder assembly and the at least one fixed die table. The support frame can be in an annular or ring-like shape and can be configured for fixing the at least one main cylinder assembly and the at least one fixed die table.

The at least one main cylinder assembly can include a cylinder body and a piston connected to the cylinder body. The cylinder body can be configured for driving the piston to press the at least one fixed die table. The support frame can includes two sets of end frames. The cylinder body can be located between the two sets of end frames. Each of the two sets of end frames can include two first buckle frames coupled to each other, and the two first buckle frames can be symmetrically arranged around a moving shaft of the piston. One end of each of the two first buckle frames can carry the cylinder body, and the other end of each of the two first buckle frames can carry the fixed die table. A pressing mechanism is formed between the piston and the fixed die table.

The oil hydraulic press can include a plurality of main cylinder assemblies, which can be coaxially arranged in a line along a telescopic direction of the piston. Each of the plurality of main cylinder assemblies can include two pistons respectively disposed on two ends of the cylinder body. The two pistons can be arranged coaxially and move in opposite directions, the support frame further can include at least one set of intermediate frames, and each of the at least one set of intermediate frames can include two second buckle frames, the two second buckle frames can be symmetrically arranged around the moving shaft of the piston, and two ends of each of the two second buckle frames can be respectively connected to two adjacent cylinder body. The oil hydraulic press can further include a plurality of fixed die tables, two fixed die tables connecting with one of the at least one set of intermediate frames can be disposed opposite to each other and between two adjacent main cylinder assemblies, and the plurality of main cylinder assemblies can cooperate with the plurality of fixed die tables, resulting in forming a plurality of pressing mechanisms which can be mutually coaxial.

The oil hydraulic press can include a main cylinder assembly, the main cylinder assembly can include two pistons which are respectively disposed on two ends of the cylinder body and mutually coaxial and move in opposite directions, and the oil hydraulic press can further include two fixed die tables, the two fixed die tables are respectively fixed on two sides of the main cylinder assembly by the two sets of end frames, resulting in forming two pressing mechanisms which are mutually coaxial.

The two first buckle frames on the same end of the support frame can be integrally formed as a buckle frame component, thereby obtaining two buckle frame components for two sets of end frames, and the two buckle frame components can be interlocked to form the support frame. The main cylinder assembly and the two fixed die tables can be disposed in an inner ring of the support frame, and the moving shaft of the two pistons can coincide with a long axis of the support frame, the two buckle frame components can be symmetrically arranged around the axis of the moving shaft of the two pistons, and the oil hydraulic press can further include a binding layer surrounding an outer surface of an outer ring of the support frame in order to pre-tighten the support frame.

The binding layer surrounding the outer surface of the outer ring of the support frame applies a pre-tightening force, in a preloading state:

$$\sigma_{1f}A_f=\eta F/2,$$

wherein, $\sigma_{1f}$ is an average compressive stress in a cross section of the buckle frame component, $A_f$ is a cross-sectional area of the buckle frame component, F is a nominal pressure of the oil hydraulic press, $\eta$ is a pre-pressure coefficient, and the pre-pressure coefficient $\eta$ is more than or equal to 0.1 and less than or equal to 0.9.

If the average compressive stress in the cross section of the buckle frame component is equal to an allowable compressive stress of $[\sigma]$, a minimum value of the cross-sectional area of the buckle frame component $A_f$ is: $A_f=\eta F/2[\sigma]$.

The buckle frame component can include a main portion and two bending portions respectively and symmetrically connected with two ends of the main portions, and the two bending portions in the buckle frame component can be connected with each other.

A connecting surface can be formed between the two buckle frame components and an angle between the long axis of the support frame and an average normal line of the connecting surface can be in a range of 10 degrees to 90 degrees.

The angle between the long axis of the support frame and the average normal line of the connecting surface can be about 90 degrees.

Two connecting surfaces can be formed between the two buckle frame components, and the two connecting surfaces can be parallel to each other or symmetrically arranged around a short axis of the support frame.

A transition layer can be further disposed between the support frame and the binding layer, the transition layer can be circumferentially wrapped around or located on the outer surface of the support frame, and a circumferential outer surface of the transition layer can have a continuous smooth transition structure that protrudes outward from the support frame.

The transition layer can include a first transition layer and a second transition layer, the first transition layer can have a ring-shaped structure and the second transition layer can be attached on the first transition layer.

Furthermore, the first transition layer can have a uniform thickness and the second transition layer can have a thickness that gradually varies along a circumferential direction.

Furthermore, the second transition layer can have a ring-like structure and a longitudinal section of the outer wall of the second transition layer can have a regular shape.

The main cylinder assembly and the fixed die table can be fixed by the support frame, which forms a ring-like structure, can be operated in one, two or multiple sets in parallel, and can realize pressing manufacturing. The oil hydraulic press has less components, reduced material consumption and low manufacturing cost.

Figure 1:
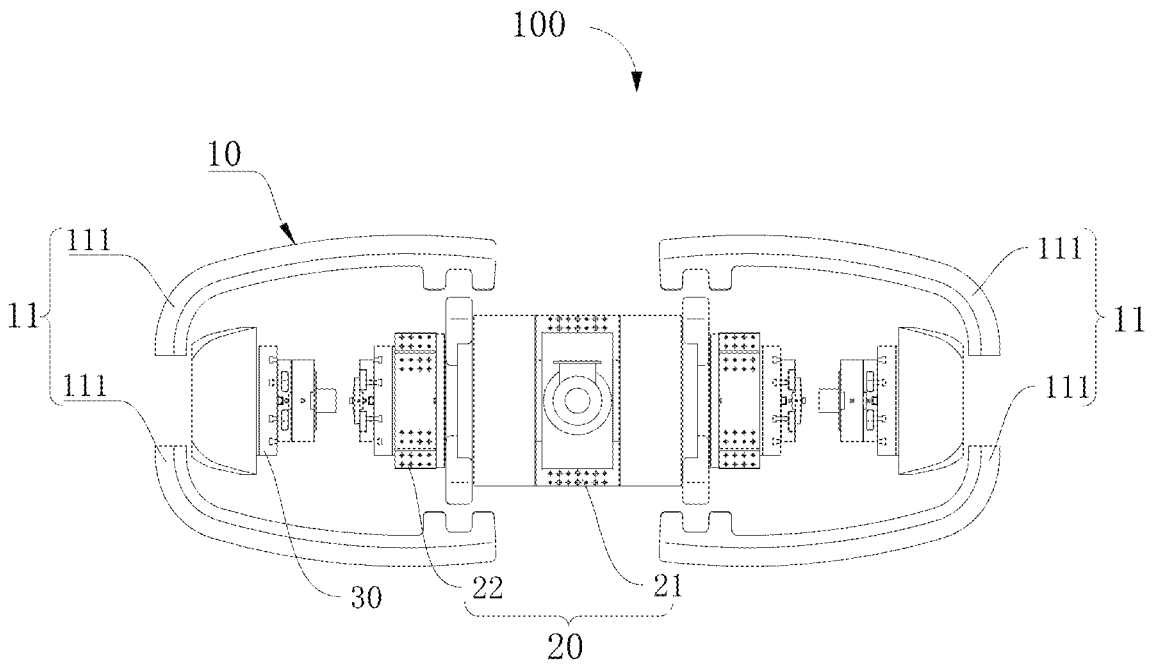
FIG. 1 is a cross-sectional view of an oil hydraulic press in a first embodiment of the present disclosure.

In the drawing, 100 is an oil hydraulic press, 10 is a support frame, 11 is an end frame, 111 is a first buckle frame, 12 is an intermediate frame, 121 is a second buckle frame, 13 is a buckle frame component, 131 is a main segment, 132 is a bending segment, 133 is a first connecting surface, 134 is a second connecting surface, 14 is a binding layer, 15 is a support base, 16 is a transition layer, 161 is a first transition layer, 162 is a second transition layer, 163 is a supporting layer, 17 is a concave groove, 20 is a main cylinder assembly, 21 is a cylinder body, 22 is a piston, and 30 is a fixed die set.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

Figure 2:
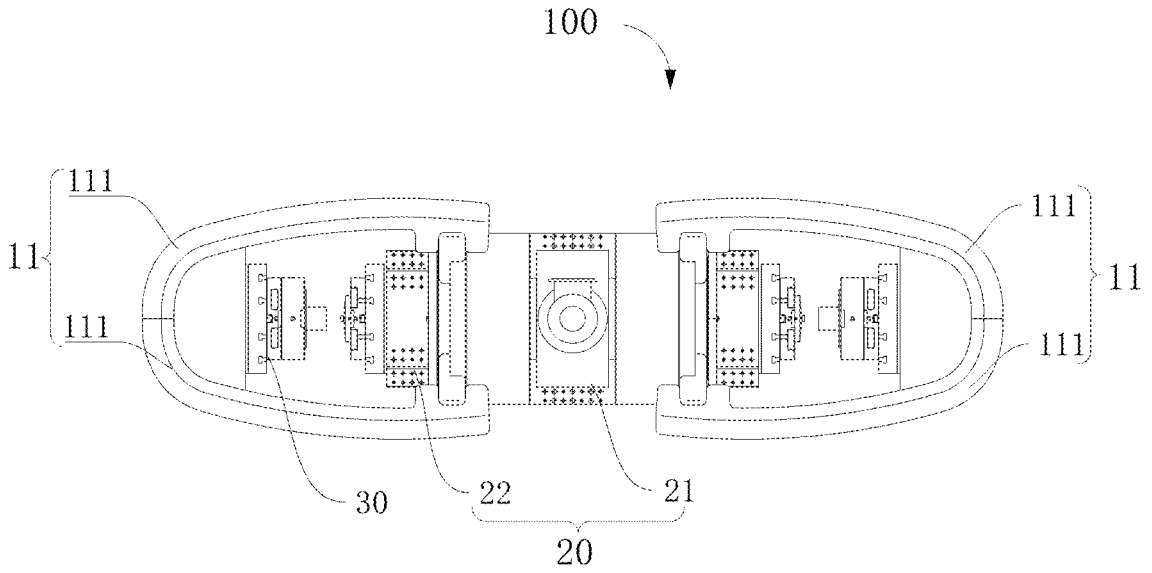
FIG. 2 is a cross-sectional view of the oil hydraulic press in FIG. 1, which is in a working state.
Figure 3:
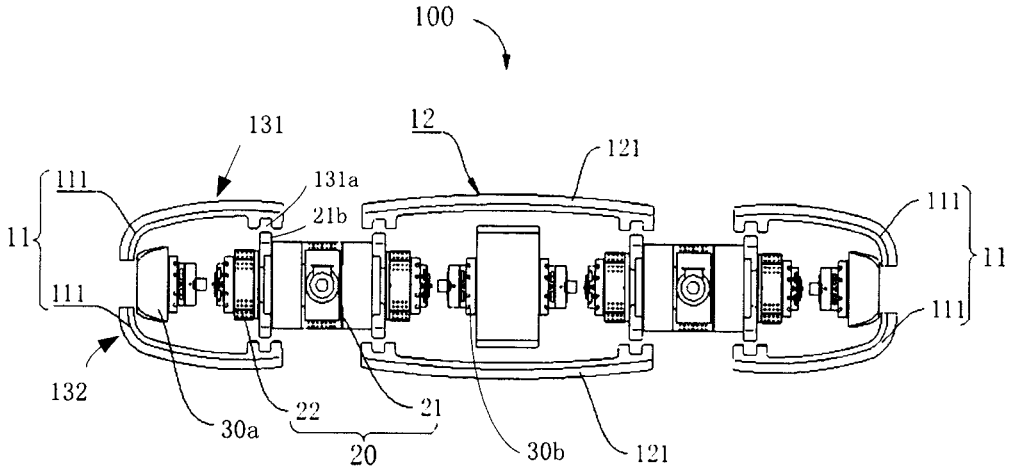
FIG. 3 is a cross-sectional view of an oil hydraulic press in a second embodiment of the present disclosure.
Figure 4:
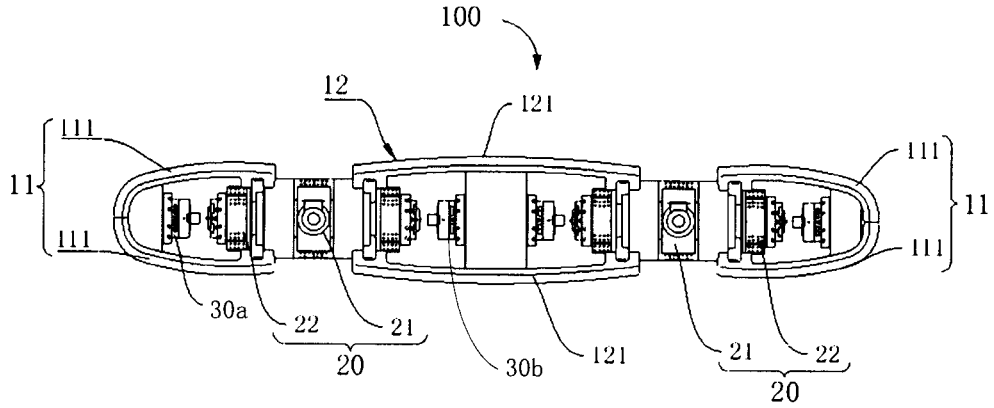
FIG. 4 is a cross-sectional view of the oil hydraulic press in FIG. 3, which is in a working state.

Referring to FIGS. 1 to 4, FIG. 1 is a cross-sectional view of an oil hydraulic press 100 in a first embodiment of the present disclosure. FIG. 2 is a cross-sectional view of the oil hydraulic press 100 in FIG. 1, which is in a working state. FIG. 3 is a cross-sectional view of an oil hydraulic press 100 in a second embodiment of the present disclosure. FIG. 4 is a cross-sectional view of the oil hydraulic press 100 in FIG. 3, which is in a working state.

The oil hydraulic press 100 includes a support frame 10, at least one main cylinder assembly 20 and at least one fixed die table 30. The main cylinder assembly 20 and the fixed die table 30 can be disposed on the support frame 10 and opposite to each other.

The support frame 10 is configured for supporting the main cylinder assembly 20 and the fixed die table 30. The main cylinder assembly 20 can serve as a power source for the oil hydraulic press 100 for providing a pressure for pressure molding. The fixed die table 30 is configured for placing a product to be stamped. The main cylinder assembly 20 can move toward the fixed die table 30 and take a stamping action, thereby manufacturing a stamped product on the fixed die table 30 by the pressure molding.

In detail, the main cylinder assembly 20 can include a cylinder body 21 and a piston 22. The support frame 10 can include at least one set of end frame 11. The at least one set of end frame 11 is composed of two first buckle frame 111, which are symmetrically arranged around a moving shaft of the piston 22. The first buckle frame 111 is in a ring-like shape with at least one gap or a half-moon shape. The cylinder body 21 is connected to one end of the buckle frame 111. The fixed die table 30 is connected to the other end of the first buckle frame 111 or a position close to the other end of the first buckle frame 111. The first buckle frame 111 fixes the cylinder body 21 and the fixed die table 30 in order to form a pressing mechanism between the piston 22 and the fixed die table 30.

In detail, the piston 22 can move toward the fixed die table 30 to finish the stamping action. The two first buckle frames 111 are symmetrically or substantially symmetrically arranged around the moving shaft of the piston for ensuring a force balance of the piston 22 and the stability of the support frame 10 during a pressing process. The first buckle frame 111 can be ring-like in shape with gaps or a half-moon shape. Preferably, the first buckle frame 111 has a curved surface that changes smoothly in curvature. The stability of the support structure is optimized because the two first buckle frames 111 are symmetrically connected with the cylinder body 21 and the fixed die table 30. In addition, when the oil hydraulic press 100 is in a working state, due to similarity or symmetry of the two first buckle frames 111, the two first buckle frames 111 will have the same or very close deformation, resulting in simplifying a connection mechanism design and increasing safety. One end of the first buckle frame 111 is connected to the cylinder body 21, and the other end of the first buckle frame 111 is connected to the fixed die table 30 to stably support the main cylinder assembly 20 and the fixed die table 30. When the piston 22 moves toward the fixed die table 30, the support frame 10 can play a role of supporting.

The number of the main cylinder assembly 20 and the fixed die table 30 in the present disclosure can be implemented in various combinations according to requirements.

For example, the number of the main cylinder assembly 20 and the fixed die table 30 can be one. At this time, the main cylinder assembly 20 includes one cylinder body 21 and one piston 22, which are supported and fixed by a set of end frame including two first buckle frames 111 to form one pressing mechanism. When the piston 22 is stamped, there will be a reaction force in order to improve efficient use and rationality of a stamping power.

In the first embodiment, the main cylinder assembly 20 is composed of one cylinder and two pistons 22. The two pistons 22 are respectively disposed at both ends of the cylinder body 21, and the two pistons 22 are coaxial and move in opposite directions. Two fixed die tables 30 are provided to cooperate with the two pistons 22 to form two coaxial pressing mechanisms. At this time, the main cylinder assembly 20 and the fixed die tables 30 are supported by two sets of end frames 11. Referring to FIG. 1, it is ensured that the two pressing mechanisms are stable and the structure of the support frame can be reduced as much as possible, resulting in the materials being reduced. At the same time, the two sets of end frames 11 can make the main cylinder assembly 20 and the two fixed tables 30 connected to form two closed structural frames, ensuring support stability.

In the second embodiment, the number of the main cylinder assemblies 20 is at least two. The two main cylinder assemblies 20 are coaxially arranged in a line along a telescopic direction of the piston 22. The number of the pistons 22 of each main cylinder assembly 20 is two. The two pistons 22 are disposed on both ends of the main cylinder assembly 20 and move coaxially in opposite directions. The number of the fixed die tables 30 is multiple. The support frame 10 includes two sets of end frames 11 and a plurality of sets of intermediate frames 12. The intermediate frame 12 is composed of two second buckle frames 121 symmetrically arranged around the moving shaft of the piston. The second buckle frame 121 has a curved shape or a curve-like shape, and two ends of the second buckle frame 121 are respectively connected to the cylinder bodies 21 of the two main cylinder assemblies 20, which are adjacent to the second buckle frame 121. Two fixed die tables 30 back to back are provided between the two adjacent main cylinder assemblies 20 and connected to the intermediate frame 12. The support frame 10 makes the main cylinder assembly 20 and the fixed die table 30 fixed, resulting in forming a plurality of coaxial pressing mechanisms. The intermediate frame 12 is configured for connecting the adjacent two main cylinder assemblies 20 to each other. Two fixed die tables 30 are disposed between two adjacent main cylinder assemblies 20 to realize the pistons 22 to form a pressing mechanism thereof. In order to fix the fixed die tables 30, the two fixed tables 30 is back-to-back and fixedly connected with the second buckle frames 121. The end frame 11 and the intermediate frame 12 respectively support different structures, resulting in forming a plurality of coaxial pressing mechanisms to meet various pressing requirements.

In order to facilitate the connection of the first buckle frame 111 and the cylinder body 21 and simplify the structure, one end of the first buckle frame 111 connected to the cylinder body 21 is provided with a groove, and the cylinder body 21 is provided with a protrusion coupled to the groove. Central axes of the protrusion and the groove are perpendicular to the moving shaft of the piston. When the piston 22 is punched, a reaction force is coaxial with the piston 22, so that the central axes of the protrusion and the groove perpendicular to the piston moving shaft can ensure that the cylinder body 21 will not move in the moving shaft of the piston. When the oil hydraulic press 100 is in operation, there is no external force in the axes of the protrusion and the groove, so that the protrusion is not separated from the groove, so that the function of fixing the cylinder body 21 can be realized and at the same time the structure is simplified. The first buckle frame 111 is connected with the fixed die table 30 by another groove and another protrusion in the same method (not shown). Preferably, an end of the first buckle frame 111 connected to the fixed die table 30 is located outside the fixed die table 30 in the punching direction of the piston 22. The end of the first buckle frame 111 connected to the fixed die table 30 is configured for limiting the displacement of the fixed die table 30 in a direction of the moving shaft of the piston 22. When the piston 22 is punched, the end of the first buckle frame 111 is located outside the fixed die table 30, that is, a distance between the end of the first buckle frame 111 and the piston 22 is greater than a distance between the fixed die table 30 and the piston 22, such that the end of the first buckle frame 111 can bear against the fixed die table 30 and provide a support for the fixed die table 30, resulting in the end frame 11 forming a support structure. In the same way, the second buckle frame 121 is also provided with another groove for engaging with another protrusion of the cylinder body 21. Since the second buckle frame 121 is only connected to the cylinder body 21, another groove is provided at both ends thereof to stably support the cylinder body 21.

The connection between the end frame 11 and the fixed die table 30 is stable, which ensures the stability in a punching or stamping process. In a preferable embodiment, ends of the two first buckle frames 111 of the end frame 11 away from the cylinder body 2 are connected to each other 1, and a connecting surface is formed at a joint of the ends of the two first buckle frames 111. An angle between the moving shaft of the piston and an average normal line of the connecting surface is in a range of 10 degrees to 90 degrees. First ends of the two first buckle frames 111 are connected to the cylinder body 21, and the second ends is required to connect to the fixed die table 30. The second ends of the two first buckle frames 111 are in contact connection, forming a connection surface at the joint of the two first buckle frames 111. The fixed die table 30 and the two first buckle frame 111 are engaged with each other. When punching, the first buckle frame 111 has sufficient strength to ensure the support. The connecting surface can be a flat surface, a segmented continuous curved surface or a smooth curved surface. The connecting surface can have a normal line perpendicular to the connecting surface. An average normal line is regarded as the neutralization of the connecting surface. For example, when the connecting surface is an arc surface, a smooth surface, or a step surface, the average normal is regarded as the neutralization. Preferably, the connecting surface is flat, the angle between the moving shaft of the piston and the average normal line of the connecting surface is about 90 degrees. The joints of the two first buckle frames 111 form a connecting surface coplanar with the moving shaft of the piston, which can further enhance the support of the fixed die table 30 and optimize the structure.

The second ends of the two first buckle frames 111 connected to each other are provided with pin holes, which are coupled to pins, resulting in restricting a displacement of the two first buckle frames 111 in a direction along the moving shaft of the piston. Due to the force of the first buckle frames 111 in a direction perpendicular to the moving shaft of the piston is minor, the first buckle frames 111 can be restricted by the pin, ensuring that the two first buckle frames 111 are not separated from each other, such that the structure is simplified and it is easy to assemble and convenient to operate. The connecting surface of the two first buckle frames 111 also has a certain frictional force in the closed state, so that the requirement for connection component or mechanism (or design difficulty) is much lower (or much easier) than that in the transmission technology. The structure of the first buckle frames 111 is related to the performance of the support structure. Preferably, the first buckle frame 111 includes a main segment and a bending segment, and the main segment and the bending segment are curved or curve-like, and a curvature of the main segment is smaller than that of the bending segment. One end of the main segment is connected with the cylinder body 21, the other end of the main segment is connected with one end of the bending segment, and the bending segments of the two first buckle frames 111 are connected to each other. The main segment and the bending segment can be an integrated structure.

In the present disclosure, the support frame 10 is configured for supporting, which can meet the requirement of the structural support, the material consumption is reduced, and the structure is simplified. In order to further reduce the material consumption, at least part of the support frame 10 can be hollow. On the basis of meeting the connection and the rigid support requirements, the end frame 11 and the intermediate frame 12 can be arranged in a hollow shape, reducing the material consumption and the weight of the support frame and optimizing the structure.

The support frame 10 of the present disclosure can fix both the main cylinder assembly and the fixed die table, forming a closed structural frame. The main cylinder assemblies and the fixed die tables can be arranged in a single group, two groups or multiple groups, which can realize pressing, reduce material consumption, weight and manufacturing costs compared with the transmission structure.

The bending segment of the end frame 11 of the present disclosure can withstand a considerable part of the working load, and a surface of the bending segment also has a certain frictional force in the closed state, so that the connection member, the mechanism requirement, or the design difficulty will be much less than the transmission technology, and it is easier to achieve structural production and manufacturing.

The end frame 11 and the intermediate frame 12 of the present disclosure are all symmetrically arranged. Due to the similarity/symmetry of the main components, they have the same deformation or close deformation when withstanding the working load, which is beneficial to the overall work of the structure and the performance is stable. The force of the support frame 10 is mainly along the moving direction of the piston, and there is almost no external force tending to separate the end frames 11 on the connecting surface, so the two end frames 11 are not with large connection stiffness as the conventional support frame. It substantially simplifies the connection mechanism design and increases safety. The oil hydraulic press 100 in the present disclosure has s reasonable structure, reduces production cost, saves resources, has strong practicability, and is suitable for application.

Referring to FIG. 1 and FIG. 2, in the first embodiment of the present disclosure, the oil hydraulic press 100 includes a support frame 10, a main cylinder assembly 20, and two fixed die tables 30. The main cylinder assembly 20 includes two pistons 22, which are respectively disposed at two ends of the cylinder body 21. The two pistons 22 are coaxial and mutually move in opposite directions. The two fixed die tables 30 are respectively disposed on two sides of the main cylinder assembly 20, and the support frame 10 includes two sets of end frames 11, which are configured for fixing the two fixed die tables 30 on both sides of the main cylinder assembly 20 respectively and forming two coaxial pressing mechanisms.

In detail, each set of end frames 11 is composed of two first buckle frames 111, which are symmetrically arranged around the moving shaft of the piston. The first buckle frame 111 includes the main segment and the bending segment, which are curved or curve-like, and the curvature of the main segment is smaller than that of the bending segment. One end of the main segment is connected with the cylinder body 21, and the other end of the main segment is connected with one end of the bending segment. The bending segments of the two first buckle frames 111 are interconnected and form a connecting surface at the joint, the connecting surface can be coplanar with the moving shaft of the piston. The end of the main segment connected to the cylinder body 21 is provided with a groove, and the corresponding cylinder body 21 is provided with a protrusion that cooperates with the groove. There are four first buckle frames 111 for the two sets of end frames 11, and the cylinder body 21 is provided with four protrusions, which are arranged at two ends of the cylinder body 21. The ends of the two first buckle frames 111 forming the connection surface are provided with pin holes, which are coupled to pins, resulting in restricting the displacement of the two first buckle frames 111 in a direction along the moving shaft of the piston.

Each set of end frame 11, the cylinder body 21, and the fixed die table 30 can form a closed structure, such that two closed structures can be formed on both sides of the cylinder body 21. Each closed structure includes a pressing mechanism, such that two pressing mechanisms in total can be formed. The pistons 22 of the two pressing mechanisms can synchronously move in opposite directions, and two sets of stamping work with the same pressure can be completed at the same time.

Referring to FIG. 3 and FIG. 4, in the second embodiment of the present disclosure, the oil hydraulic press 100 includes a support frame 10, two main cylinder assemblies 20, and four fixed die tables 30. The two main cylinder assemblies 20 are arranged in a line, and two pistons 22 of the main cylinder assembly 20 are respectively disposed at the two ends of the cylinder body 21 and coaxial and mutually move in opposite directions, so that the moving shafts of the pistons of the two main cylinder assemblies 20 are coaxial. There are four fixed die tables 30, which are two separate first fixed die tables 30*a* and two second fixed die tables 30*b* disposed back to back. The support frame 10 includes two sets of end frames 11 and a set of intermediate frames 12.

In detail, the end frame 11 is composed of two first buckle frames 111. The two first buckle frames 111 are symmetrically distributed symmetrically about the axis of movement of the piston. The first buckle frame 111 includes a main segment 131 and a bending segment 132. The main segment 131 and the bending segment 132 are curved or curve-like, and the curvature of the main segment 131 is smaller than that of the bending segment 132. One end of the main segment 131 is connected with the cylinder body 21, and the other end of the main segment 131 is connected with one end of the bending segment 132. The bending segments 132 of the two first buckle frames 111 are connected to each other and form a connecting surface at the joint, which is coplanar with the moving shaft of the piston.

The intermediate frame 12 is composed of two second buckle frames 121 symmetrically arranged around the moving shaft of the piston. The second buckle frame 121 has a curved shape or a curve-like shape, and two ends of the second buckle frame 121 are respectively connected to the cylinder bodies 21 of the two main cylinder assemblies 20. Two second fixed die tables 30*b* back to back are provided between the two adjacent main cylinder assemblies 20 and connected to the second buckle frame 121.

The ends of the first buckle frame 111 and the second buckle frame 121 connected with the cylinder body 21 are provided the groove 131*a*, and the cylinder body 21 is correspondingly provided with the protrusion 21*b* that cooperates with the groove 131*a*. The two sets of end frames 11 include four first buckle frames 111 in total. A set of intermediate frames 12 includes two second buckle frames 121 in total. Since both ends of the second buckle frame 121 are connected with the cylinder body 21, each main cylinder assembly 20 is provided with four protrusions 21*b*. In the first buckle frame 111, the bending segment forming the connection surface is provided with pin holes, which are coupled to pins, resulting in restricting a displacement of the two first buckle frames 111 in a direction along the moving shaft of the piston. After the installation is completed, the end frames at both ends cooperate with the cylinder body 21 and the two separate first fixed die tables 30*a* to form two pressing mechanisms, and the intermediate frame 12 cooperate with the cylinder body 21 and the two second fixed die tables 30*b* back to back to form two pressing mechanisms. That is, four closed structural frames can form four pressing mechanisms in total. Since the pistons 22 of the main cylinder assemblies 20 are coaxial, the formed four pressing mechanisms are coaxial.

It can be understood that when the intermediate frames 12 are omitted, the two first buckle frames 111 located above or below may be integrated, that is, the two first buckle frames 111 can be symmetrically arranged around the moving shaft of the piston (that is, the long axis of the support frame in an ellipse shape).

The support frame 10 of the present disclosure can fix both the main cylinder assemblies 20 and the fixed die tables 30, forming a closed structural frame. The main cylinder assemblies and the fixed die tables can be arranged in a single group, two groups or multiple groups, which can realize pressing, reduce material consumption, weight and manufacturing costs compared with the transmission structure.

The support frame 10 needs to support the main cylinder assembly 20 and the fixed die table 30 and withstand a back pressure from the main cylinder assembly 20 and the fixed die table 30 during operation. In the conventional hydraulic press, a steel wire or steel strip winding on the external surface is often used to enhance the safety of the support frame 10. However, in the conventional design, the steel wire or the steel strip usually give a pre-tightening force exceeding a nominal force, the support frame 10 is always under pressure, and the tensile performance of the support frame 10 cannot be fully utilized, which seriously wastes the material and in some extent, the safety and reliability of the whole machine is reduced. In addition, the winding steel wire often slips due to insufficient friction. Simply increasing a sliding limit device will inevitably increase a working tension of the steel wire and the risk of fracture will be higher. Furthermore, the support frame 10 will unevenly apply the pressure, it is hard to utilize and make full use of the overall mechanical properties of the support frame 10.

The oil hydraulic press 100 provided by the present disclosure adopts a bundling connection mechanism, reasonably design the pre-stress of the bundling layer on the support frame 10, fully balance the stress state of the base material and the bundling material, and exert the characteristics that the material can simultaneously withstand the tension and the pressure, so that the number of components of the support frame 10 is significantly reduced. On the basis of meeting the support requirements, the material consumption and cost can be minimized, and the safety performance of the whole machine is substantially improved.

Figure 5:
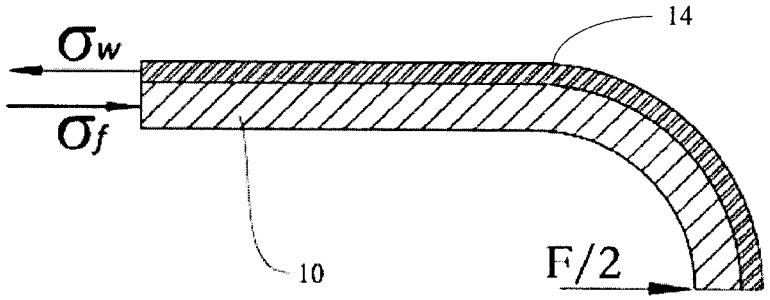
FIG. 5 (Prior art)
FIG. 5 is a cross-sectional view showing a support frame of an oil hydraulic press in prior art, which is under a force in a working state.
Figure 6:
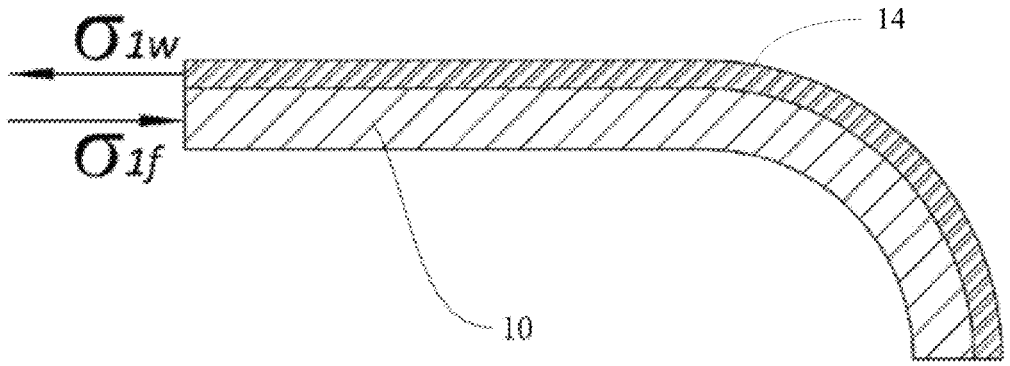
FIG. 6 is a cross-sectional view showing a force on a support frame of an oil hydraulic press in the present disclosure, which is under in a preloading state.
Figure 7:
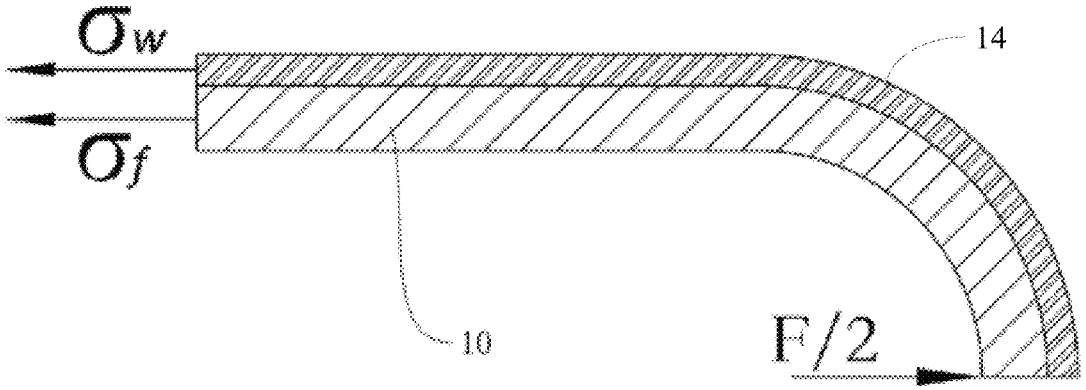
FIG. 7 is a cross-sectional view showing a force on a support frame of an oil hydraulic press in the present disclosure, which is under a force in a working state.

Referring to FIG. 5 to FIG. 7, FIG. 5 shows a support frame of an oil hydraulic press in prior art, which is under a force in a working state. FIG. 6 shows a cross-sectional view showing a force on a support frame of an oil hydraulic press in the present disclosure, which is under in a preloading state. FIG. 7 shows a cross-sectional view showing a force on a support frame of an oil hydraulic press in the present disclosure, which is under a force in a working state.

Referring to FIG. 5, in the conventional bundling technique, the support frame 10 in the prior art is generally locked together by the binding layer 14 (usually binding steel wires and belts). The force on support frame 10 satisfies the following formula:

$$\sigma_w A_w = \sigma_f A_f = \eta F/2$$

Wherein, $\sigma_w$ and $\sigma_f$ are an average tensile stress and compressive stress on a cross-section of the binding layer 14 and the support frame 10, respectively. $A_w$ and $A_f$ represent a cross-sectional area of the binding layer 14 and the support frame 10, respectively. F is a nominal pressure of the oil hydraulic press, and $\eta$ is a pressure coefficient. The binding force is generally greater than the nominal pressure, that is, the pressure coefficient $\eta$ is greater than 1. The support frame 10 is still under pressure if the oil hydraulic press is in the working state. As a result, the strong support frame 10 only plays a role of an entangled plate and always bears the compressive stress, its huge tensile property does not come into play. Correspondingly, the binding layer 14 undergoes a tensile force exceeding the nominal force under the pre-stressing state, and in the working state, it additionally undergoes a tension caused by the pressing force. That is, only the material of the binding layer 14 really bears all the working loads and does the positive work. So the structural performance of the binding layer 14 is required much higher, and at the same time, the structure of the support frame 10 does not exhibit its tensile property.

Referring to FIG. 7, the oil hydraulic press 100 in the present disclosure has a resultant force acting on the cross section of the support frame in the preloading state and the resultant force is zero, that is explained as following:

$$\sigma_{1w}A_w=\sigma_{1f}A_f=\eta F/2 \quad (1)$$

$\sigma_{1w}$ and if are the average tensile stress and compressive stress acting on the binding layer 14 and the cross section of the base member, respectively. $A_w$ and $A_f$ represent the sectional area of the binding layer 14 and the base member. F is the nominal pressure of the oil hydraulic press 100. η is a pressure coefficient or a pre-pressure coefficient. When the oil hydraulic press 100 is in operation, the support frame 10 will be in a tensile state and undergo the stress, and the total stress of the binding layer 14 and the base member is:

$$\sigma_w=\sigma_{1w}+\sigma_{2w}$$

$$\sigma_f=\sigma_{2f}-\sigma_{1f}.$$

$0.1\leq\eta\leq0.9$, if it is replaced by relevant design parameters, will be as following:

$$\sigma_{1f}A_f=\eta F/2$$

$\sigma_{1f}$ is equal to an allowable compressive stress of [σ], and a minimum value $A_f$ of the cross-sectional area of the buckle frame component 13 is:

$$A_f=\eta F/2[\sigma] \quad (2)$$

It should be noted that in the conventional technology, the pressure coefficient η is required to be greater than 1, η is usually equal to 1.2. In the present disclosure, the formulas (1) and (2) shows that the cross-sectional area $A_f$ of the support frame in the present disclosure can be reduced by several times compared with that of the conventional support frame. The structure of the oil hydraulic press of the present disclosure can effectively reduce the use of materials, and the support frame 10 can be used as a tensile member during the operation of the oil hydraulic press, thereby reducing the pre-stress of the binding layer 14 and structural stress and simplifying its structure.

Figure 8:
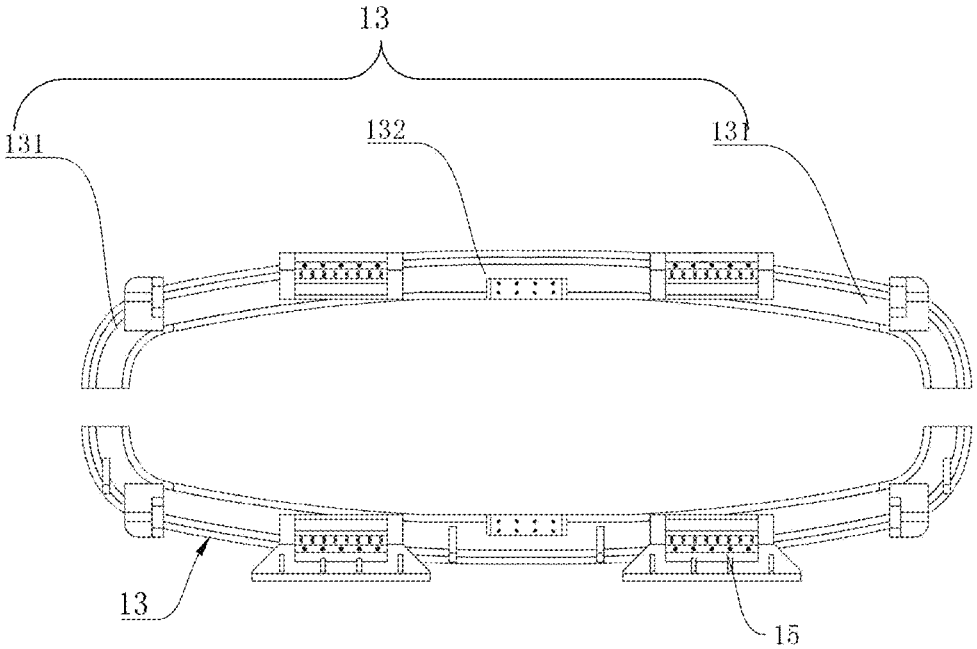
FIG. 8 is a cross-sectional view of a support frame of an oil hydraulic press in a third embodiment of the present disclosure.
Figure 9:
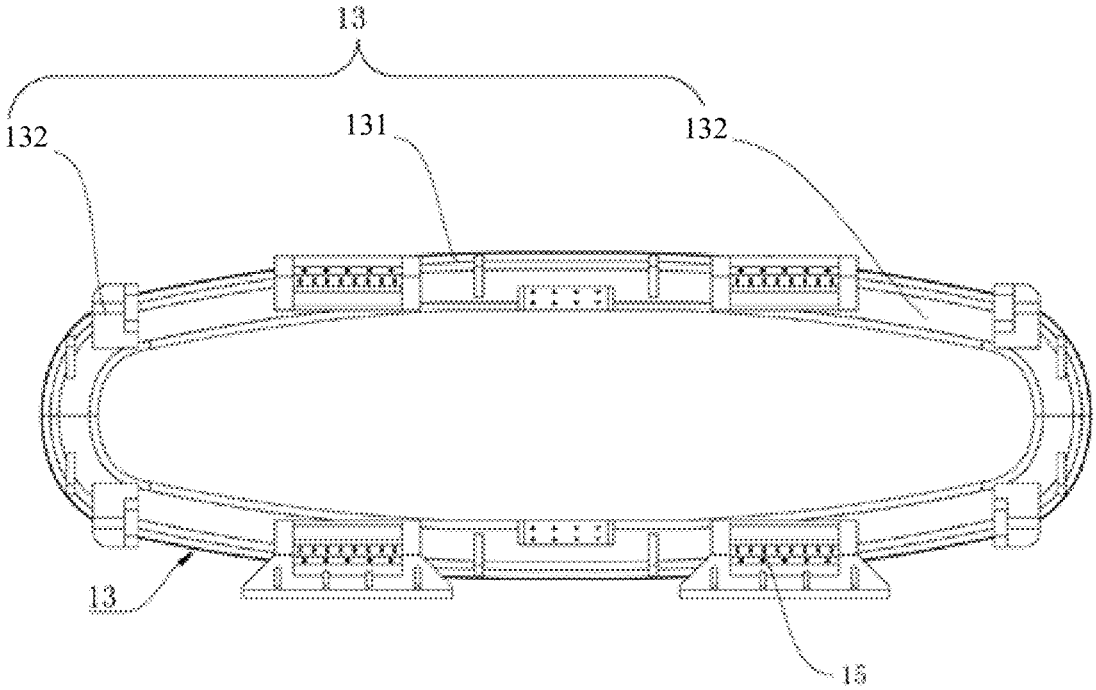
FIG. 9 is a cross-sectional view of the support frame of the oil hydraulic press in FIG. 8, which is in a buckled state.
Figure 10:
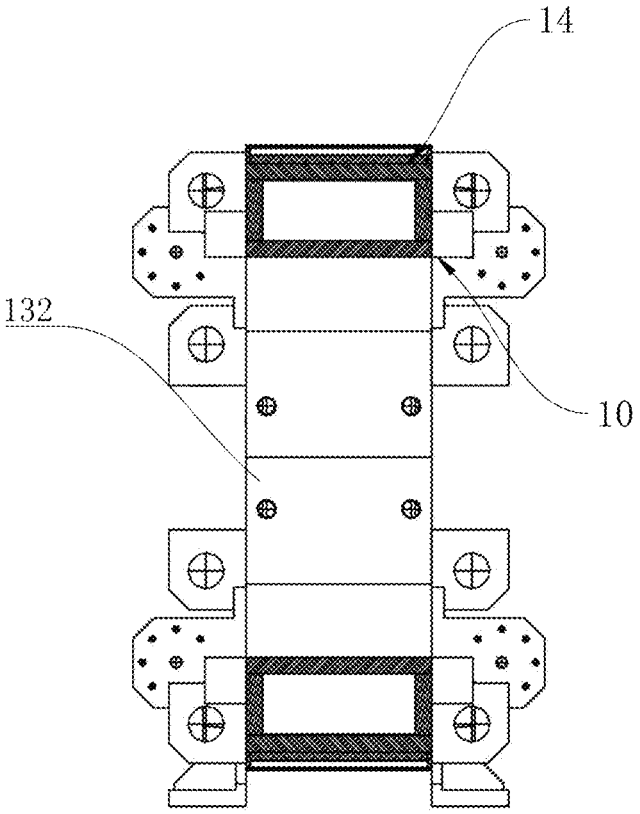
FIG. 10 is a cross-sectional view of the support frame in FIG. 8.

Referring to FIG. 8 to FIG. 10, FIG. 8 shows a cross-sectional view of a support frame of an oil hydraulic press in a third embodiment of the present disclosure. FIG. 9 shows a cross-sectional view of the support frame of the oil hydraulic press in FIG. 8, which is in a buckled state. FIG. 10 shows a cross-sectional view of the support frame in FIG. 8. The support frame 10 has a ring structure or a ring-like structure including an outer ring, an inner ring, and a hollow in the inner ring. The main cylinder assembly 20 and the fixed die table 30 can be installed in the inner ring.

Preferably, the outer ring of the support frame 10 is in an elliptical shape. Furthermore, the longitudinal section of the support frame 10 is in an olive-like shape with a thickness. The outer shape of the support frame 10 has an olive shape, that is, the support frame 10 has an olive-shaped appearance. The olive-shaped support frame can provide a pre-stress of a curved support and has a stronger structural stability. At the same time, the inner ring can maximize the space for compression equipment, reducing the weight of the equipment and the use of materials when the equipment requirements are met.

In this embodiment, the intermediate frame 12 can be directly omitted, and the two first buckle frames 111 on the same side of the two end frames 11 can be integrally formed to a buckle frame component 13. The two buckle frame components 13 can be symmetrically or substantially symmetrically arranged around the long axis is symmetrically arranged of the support frame, and the connecting surface formed at the joint of the two buckle frame components 13 can be a flat surface, a segmented and continuous curved surface, or a smooth curved surface. Preferably, the connecting surface is a flat surface.

The angle between the connecting face of the two buckle frame components 13 and the long axis of the support frame 10 is 0°, that is, coplanar.

When the oil hydraulic press 100 is operated telescopically along the long axis, and both ends of the long axis of the support frame 10 undergo a tensile force. Therefore, a bending portion at the joint of the two buckle frame components 13 is mainly pressed. The two buckle frame components 13 are fastened along the long axis. If the two buckle frame components 13 are not subjected to a separating force, that is, a force along the short axis, and they only needs to be fixed along the long axis. Compared with the conventional structure, under the condition of satisfying the pressure, such structure is less stressed and its design is more reasonable.

In this embodiment, each of the buckle frame components 13 includes a main segment 131 and two bending segments 132. The two bending segments 132 are symmetrically connected at two ends of the main segment 131. When the two buckle frame components 13 are fastened together, the bending segments 132 of the two buckle frame components 13 are connected to each other, and a connecting surface is formed at the joint of the bending segments 132. Preferably, the connecting surface can be a plane, which is coplanar with the long axis.

The main cylinder assembly 20 and the fixed die table 30 which provide a forming pressure in the oil hydraulic press 100 are disposed in the inner ring of the support frame 10. An extension and contraction direction of the oil hydraulic press 100 coincides with its long axis, and the angle between the connecting surface and the long axis is 0 degree. The two buckle frame components 13 are combined to form a closed structural frame. The binding layer 14 will combine the buckle frame components 13 and provide pressure to form the closed structural frame. When the oil hydraulic press 100 is in operation, the oil hydraulic press 100 will extend or contract along the long axis. The bending segments 132 at both ends of the buckle frame component 13 are located at both ends of the long axis and undergo a considerable part of the working load. The support frame 10 mainly undergoes a force along a moving direction of a cylinder column. There is almost no external force tending to separate them the two buckle frame components 13 on the connecting surface, which reduces the requirements for interconnecting the bending segments 132. The main segment 131 and the bending segment 132 can be connected by a connecting component, which includes a spacer block or a screw. The main segment 131 and the bending segment 132 can be provided with screw holes. To further improve the rigidity of the buckle frame component 13, the main segment 131 and the two bending segments 132 of the buckle frame component 13 can be an integrated structure. Preferably, components of the oil hydraulic press 100 on the left and on the right can work at the same time, and a telescopic force on the left is the same as that on right. The oil hydraulic press 100 is located at the center of the support frame 10, and the bending segments 132 at both ends are respectively located at the left and right pressure points. Due to the closed structure, the buckle frame component 13 is balance-loaded on the left and the right, so that requirement for the connection of the two buckle frame components 13 can be reduced.

In actual production, the support frame 10 needs to be stably installed, so the support frame 10 may further be provided with a support base 15 mounted on one of the buckle frame components 13. One end of the bending segment 132 forming the connecting surface is provided with a pin hole coupled to a pin. And the two buckle frame components 13 restrict the displacement along the long axis by the pin, which also helps the positioning. The bending segments 132 are connected to each other through the pin. Due to the force on the bending segment 132 is limited along a direction of the long axis, it only needs to ensure that the two buckle frame components 13 will not leave away the fixed position. The bending segments 132 are fixed by the pin, which simplifies the structure and is easy to assemble and convenient to operate. The connecting surface of the bending segment 132 also has a certain frictional force in the closed state, so that the requirement for connection component or mechanism (or design difficulty) is much lower (or much easier) than that in the transmission technology. The displacement of the two buckle frame components 13 along the short axis needs a certain limitation, which is ensured by the binding force. The support frame 10 is further provided with the binding layer 14. The support frame 10 is provided with a groove surround the surface of the outer ring, and the binding layer 14 is located in the groove and not higher than a depth of the groove. A width of a bottom surface of the groove can be the same as that of an opening of the groove. A width of the binding layer 14 can be the same as the width of the bottom surface of the groove. The support frame 10 is bound by the binding layer 14 on the outer ring. The pre-compression of the binding force can be set to an appropriate value according to the structural shape and material properties to ensure the structure is under an allowable pressure value in the preloading state and the tensile stress in the working state are within an allowable range. It is not necessary that the binding force must be greater than the nominal pressure of the oil hydraulic press as in the prior art to ensure that the column portion and the top beam are not separated in operation. Preferably, the binding layer 14 can be a bundled steel wire (or steel strip), the bottom surface of the groove is a non-smooth surface, both of which will increase the friction force, thereby ensuring the stability and structural rigidity of the winding structure, reducing the deformation of the support frame 10, and guarantee the stability of the support frame 10. Furthermore, the main segment 131 and the bending segment 132 of the support frame 10 can be hollow or partially hollow, which further reduces the use of materials on the basis of satisfying the requirements for connection and rigid support.

The present disclosure adopts a bundling connection mechanism, and the pre-stress of the binding layer 14 on the support frame 10 can be set to any reasonable value according to design requirements. The pre-compression bundling force can be set to an appropriate value according to the structural shape and material characteristics, ensuring that the pre-compression bundling force of the skeleton structure is less than the maximum allowable pressure value in the preloading state, and that the tensile stress in the working state is within an allowable range. In the prior art, the binding force of the oil hydraulic press should be greater than the nominal pressure to ensure the column portion and the top beam not being separated in the working state, while it is not necessary in present disclosure.

The combination of the support frame 10 and the binding layer 14 in the present disclosure can balance the stress state of the material of the support frame 10 and the material of the binding material, showing that the material can simultaneously withstand the tension and compression. The number of components of the support frame is significantly less than that of components of the support frame in the prior art. On the basis of ensuring the mechanical properties of the structure, it can minimize the use and cost of the material and substantially increase the safety performance of the overall structure.

In the present disclosure, due to both the support frame 10 and the binding layer simultaneously bear the working load, even one of them is completely broken or destroyed, the other one can still bear full of the working load. The binding structure can ensure the safety support of the frame structure to an extreme, which is reasonable, easy to implement, practical, and suitable for application.

Furthermore, an angle between the long axis of the support frame 10 and an average normal line of the connecting surface formed between the two buckle frame components 13 is in a range of 10 degrees to 90 degrees. The normal line is regarded as being perpendicular to a surface. The average normal line is regarded as the neutralization of the connecting surface. If the connecting surface is a circular arc, a smooth curved surface or a stepped surface, the average normal line is regarded as the neutralization value. The oil hydraulic press 100 can be extended and contracted in the direction of the long axis, and both ends of the support frame 10 in the long axis undergoes mainly the pulling force. Therefore, the joint of the two buckle frame components 13 are mainly subjected to a shearing force and not subjected to any force for separating along the short axis, it only needs to fix the two buckle frame components 13 along the long axis. In particular, when the upper and lower buckle frame components 13 are symmetrically shaped (or symmetrically deformed), there is no or almost no shearing force. Compared with the prior art, this structure is less stressed and the design is more reasonable under the condition of being subjected to the tension and compression.

Figure 11:
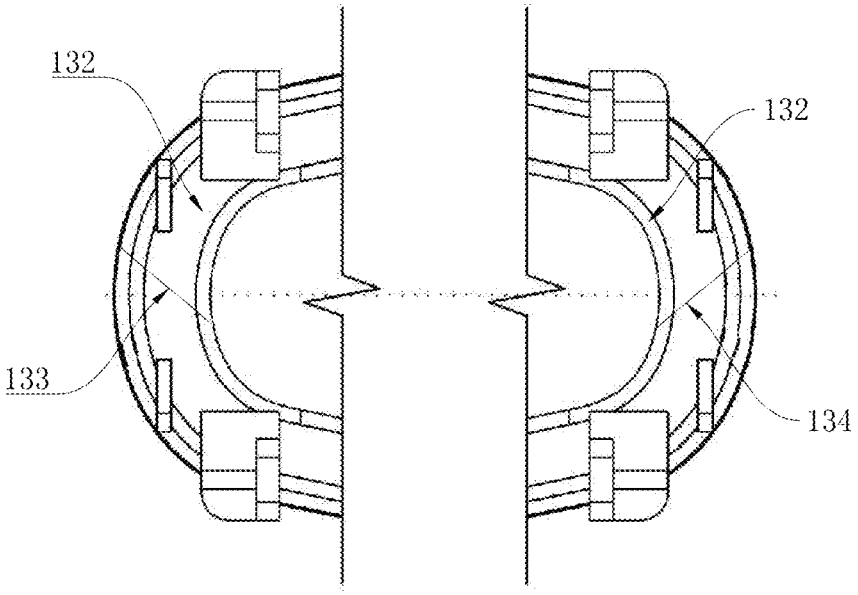
FIG. 11 is a cross-sectional view showing connecting surface in an embodiment of the present disclosure.
Figure 12:
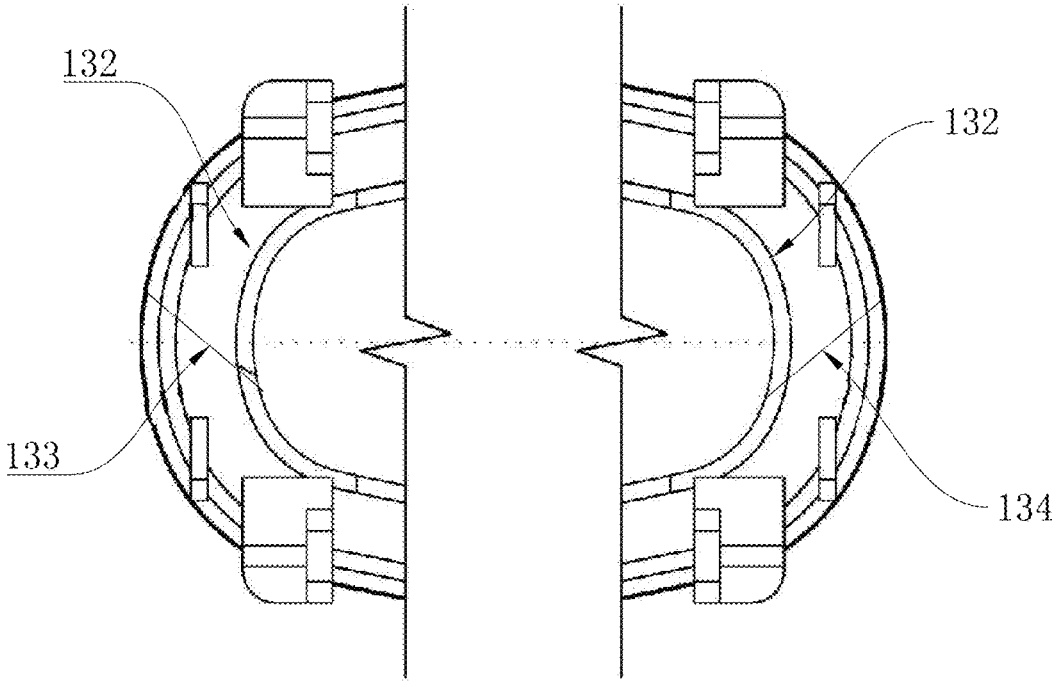
FIG. 12 is a cross-sectional view showing connecting surface in another embodiment of the present disclosure.

Referring to FIG. 11 and FIG. 12, FIG. 11 shows a cross-sectional view showing connecting surface in an embodiment of the present disclosure, and FIG. 12 shows a cross-sectional view showing connecting surface in another embodiment of the present disclosure. Preferably, the connecting surface of the buckle frame components 13 is two planes, which are respectively defined as a first connecting surface 133 and a second connecting surface 134 parallel to each other (as shown in FIG. 10), or symmetrically arranged around the short axis (as shown in FIG. 11). Regardless of the arrangement, the forces along the long axis and the short axis of buckle frame components 13 are limited.

Therefore, the angle between the long axis of the support frame 10 and the average normal of the connection face is in the range of 10 degrees to 90 degrees. That is, the long axis is on the first connection plane 133 and the second connection plane 134, while the two buckle frame components 13 are substantially unstressed on the short axis.

Figure 13:
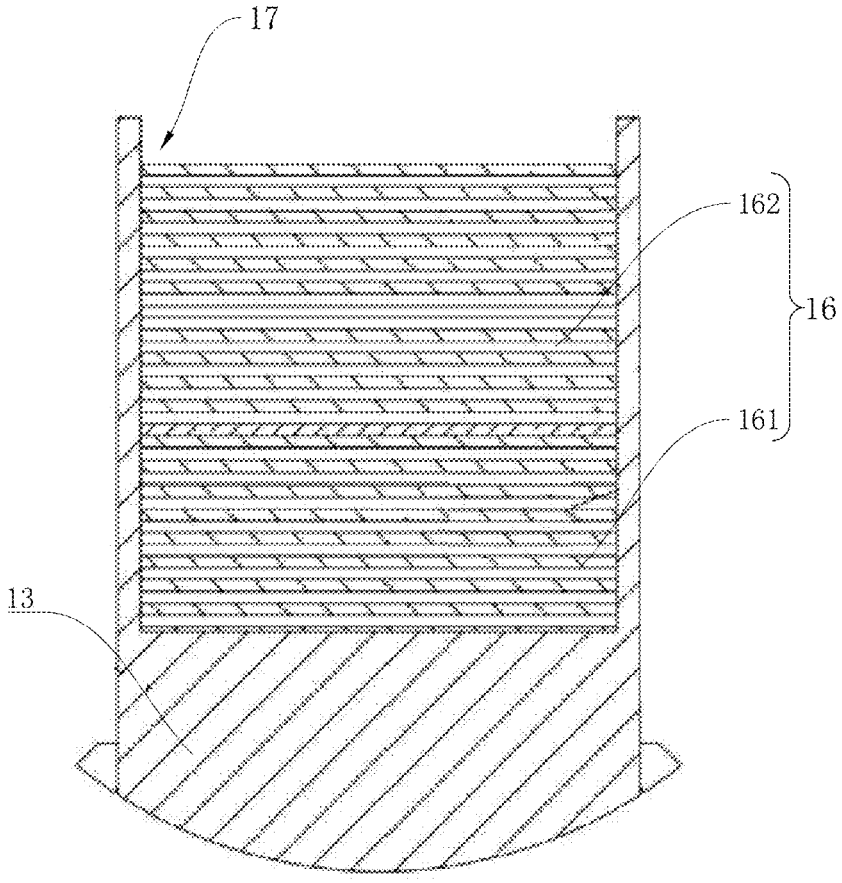
FIG. 13 is a cross-sectional view of a part of a support frame of an oil hydraulic press in a fourth embodiment of the present disclosure.

Referring to FIG. 13, FIG. 13 shows a cross-sectional view of a part of a support frame of an oil hydraulic press in a fourth embodiment of the present disclosure. To further improve the reliability and stability of the support frame 10, the support frame 10 is further provided with a transition layer 16, which is circumferentially wrapped around or located on the outer surface of the support frame 10. A circumferential outer surface of the transition layer 16 has a continuous smooth transition structure that protrudes outward from the support frame 10.

Figure 14:
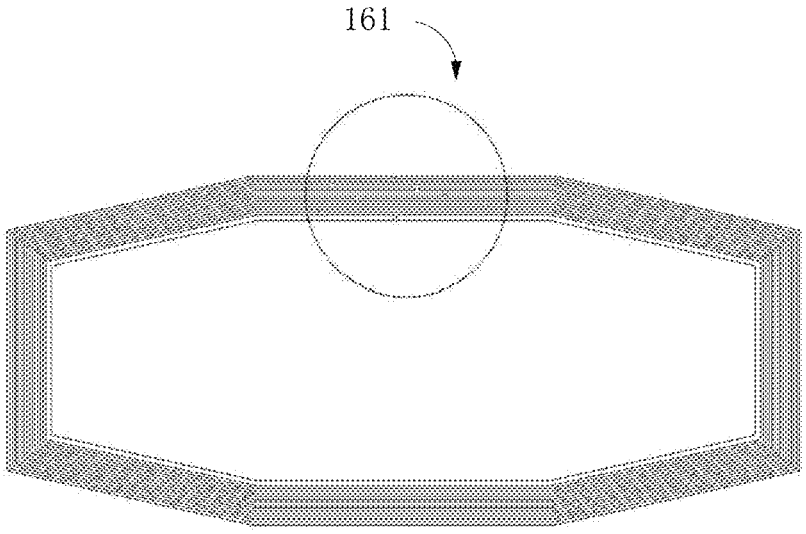
FIG. 14 is a cross-sectional view of a first transition layer of the present disclosure.
Figure 15:
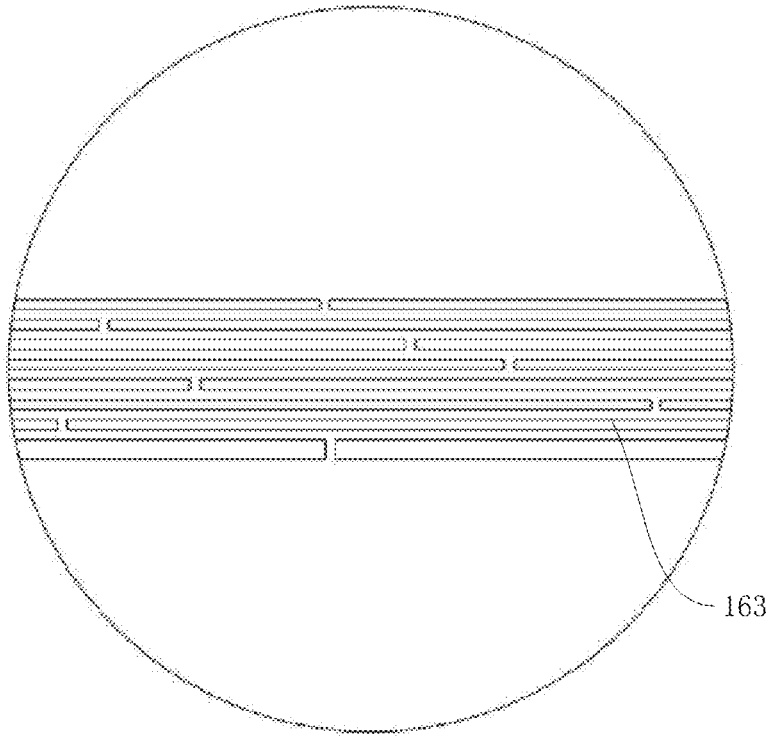
FIG. 15 is an enlarged view of a part of the first transition layer in FIG. 14.
Figure 16:
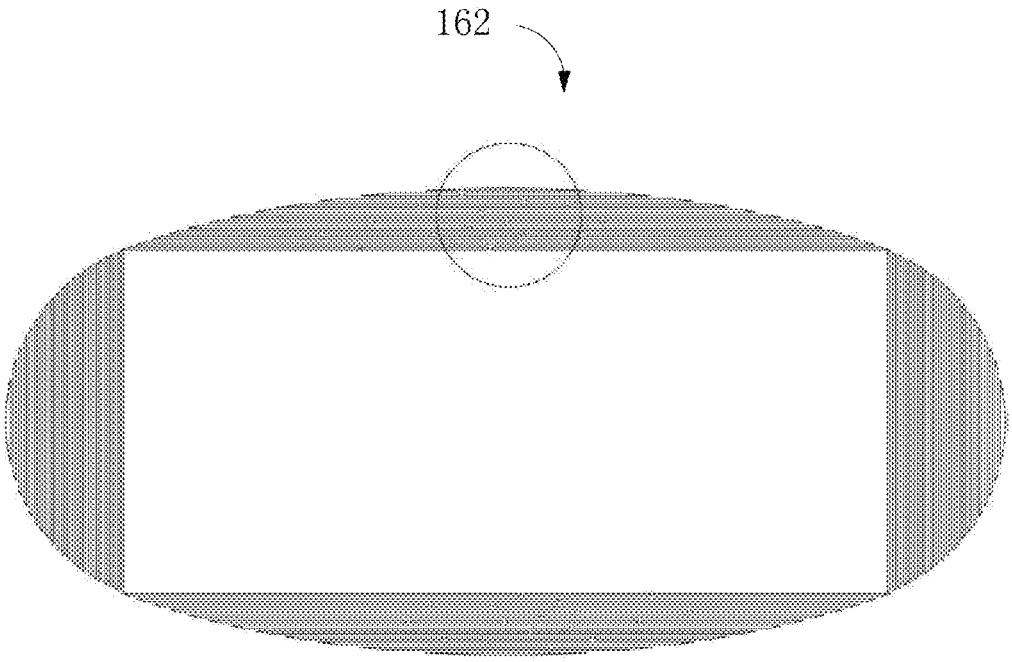
FIG. 16 is a cross-sectional view of a second transition layer of the present disclosure.
Figure 17:
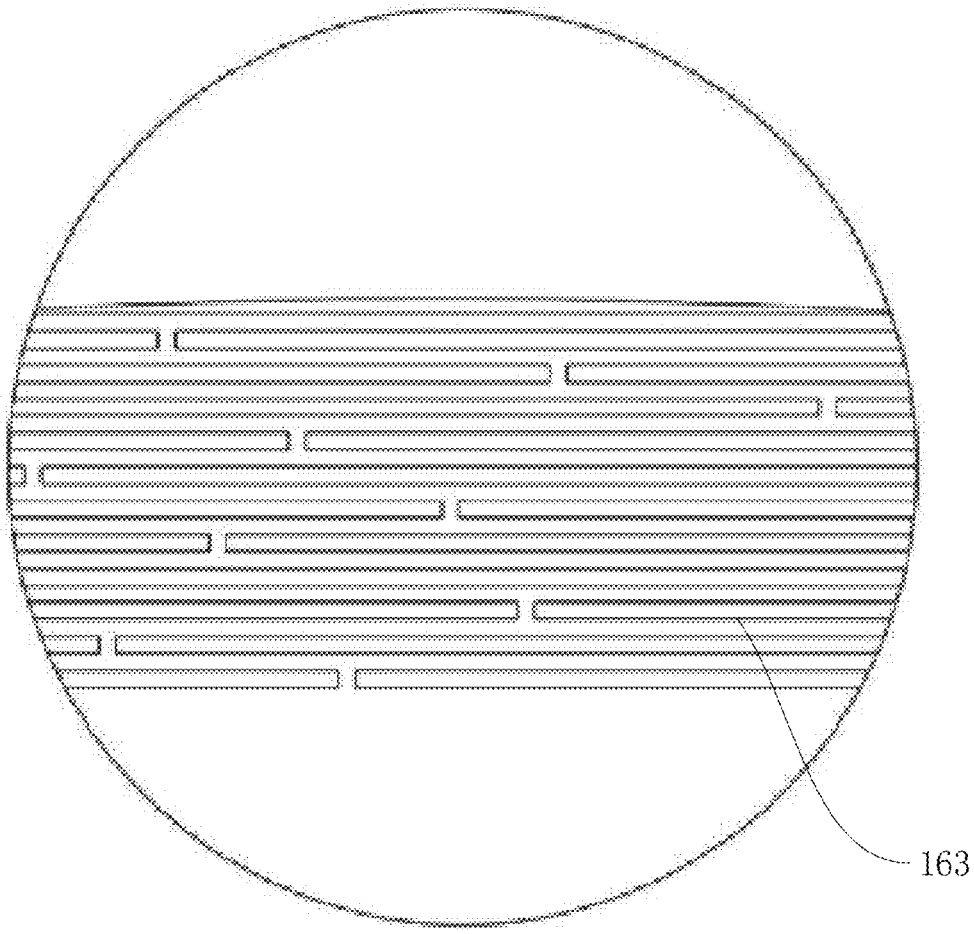
FIG. 17 is an enlarged view of a part of the second transition layer in FIG. 16.

Furthermore, referring to FIG. 14 to FIG. 17, FIG. 14 shows a cross-sectional view of a first transition layer of the present disclosure, FIG. 15 shows an enlarged view of a part of the first transition layer in FIG. 14, FIG. 16 shows a cross-sectional view of a second transition layer of the present disclosure, and FIG. 17 shows an enlarged view of a part of the second transition layer in FIG. 16. The transition layer 16 can serve as a covering structure for the support frame 10, and provide a supporting force for tighten the support frame 10 and a bundled frame for the bundled wire. The transition layer 16 at least includes a first transition layer 161 and a second transition layer 162. The first transition layer 161 is a ring-shaped layer and attached on the outer surface of the support frame 10. The second transition layer 162 is attached on the first transition layer 161. The function of the first transition layer 161 is to uniformly coat and tighten the support frame 10 to provide support. The function of the second transition layer 162 is to optimize the outer wall of the transition layer to a continuous smooth transition shape, which improves binding strength of the transition layer to the support frame 10 and provides a better geometry for the bundled steel wire. After the bundled wire is wound, due to the smooth transition structure, the structure can meet the requirement of high strength support.

Preferably, the thickness of the first transition layer 161 can be uniform, and the thickness of the second transition layer 162 varies as a function, that is, the thickness of the second transition layer 162 is gradually varies along a circumferential direction. The first transition layer 161 having a uniform thickness can ensure uniform force in all directions around the support frame 10, and the thickness of the second transition layer 162 which changes in function can provide a continuous smooth transition outer wall. Of course, the relationship of the function can be optimized as a geometric formula. The second transition layer 162 can be a ring-shaped layer, and a longitudinal section of the outer wall of the second transition layer 162 satisfies a regular geometric formula, such as a geometric formula of a circle, an ellipse, an olive, or the like, that is, a longitudinal section of the outer wall of the second transition layer 162 is a regular geometry.

Preferably, the longitudinal section of the outer wall of the second transition layer 162 can be elliptical or olive-shaped, which has a long axis and a short axis and facilitates the structural components placing in the inner ring of the support frame 10. The elliptical or olive-like shape is beneficial to improve the stability of the structure and enhance mechanical property.

The transition layer 16 serves as a reinforced component of the support frame 10. The structure of the transition layer 16 is simplified, which is convenient for the production and processing of the present disclosure. The transition layer 16 can be composed of a plurality of supporting layers in staggered arrangement. That is, both the first transition layer 161 and the second transition layer 162 are composed of the plurality of supporting layers in staggered arrangement. The thickness of the plurality of supporting layers 163 is in a multiple ratio relationship. And the supporting layer 163 can be formed by a plurality of steel sheets having the same thickness and stitching end to end. The supporting layer 163 can be stacked into a desired shape by the plurality of steel sheets with different lengths. In a manner of staggered overlap, the plurality of supporting layers 163 can form the transition layer 16. The plurality of supporting layers 163 can be preferably in the same thickness, and the slits can be distributed to prevent gathering in a certain position or a small area, leading to the pressure reduced and the structural strength not large enough. At the same time, each of the supporting layers 163 is formed by splicing a plurality of steel plates end to end, so that the remaining material or waste in the production can be utilized. Due to the overlapping arrangement of the supporting layers 163, the strength of the support structure can be ensured and the materials are reduced. In addition, the steel plate of the supporting layer 163 can be spliced end to end in the different shapes, which can satisfy the requirement for the strength and reduce the limiting of the steel plate, for example, a plurality of steel plates of different sizes and shapes or cut-off regions can be used for the splicing.

The support frame 10 is provided with a groove 17 along the peripheral surface of the outer ring, and the transition layer 16 is disposed in the groove 17. The top surface of the transition layer 16 is not higher than a top edge of the groove 17. The width of the bottom surface of the groove 17 is equal to or smaller than the width of an opening of the groove 17. The width of the transition layer 16 is constant or consistent with the cross section of the groove 17. The groove 17 is disposed along the peripheral surface of the outer ring of the support frame 10, and the groove 17 is also closed. Here, side wall of the groove 17 may be protruded from the outer ring of the support frame 10*a*. The groove 17 is configured for limiting the transition layer 16 and the bundled steel wire, which facilitates the binding of the transition layer and the bundled steel wire on the support frame 10. The transition layer 16 is disposed on the bottom surface of the groove 17. The transition layer 16 can also be in a ring shape, so that the bottom surface of the groove 17 is coated with the transition layer 16. The transition layer 16 is wrapped by the bundled steel wire and bundled with the support frame 10 to form a support frame by the pre-stress. It should be noted that the thickness of the bundled steel wire cannot exceed the top edge of the groove 17, which can ensure a stable mechanical performance of support of the support frame, and also the beauty and practicality, and avoid the bundled steel wire projecting the groove 17 to affect placement and installation. Preferably, the width of the bottom surface of the groove 17 is the same as the width of the opening of the groove 17, the width of the transition layer 16 is the same as the width of the bottom surface of the groove 17, or the width of the transition layer 16 is slightly smaller than the width of the bottom surface of the groove 17, so that it is convenient to install the transition layer. After the installation of the transition layer 16, the bottom surface of the groove 17 can be tightly coated, and there is no gap between the transition layer 16 and the side wall of the groove 17, so that the bundled steel wire will not directly pressed on the bottom surface of the groove 17 when the bundled wire is wound. Of course, the thickness of the transition layer 16 may be uniform or unchanged. Alternatively, the transition layer 16 can be adapted to the cross section of the groove 17, and closely adhered to the bottom surface and the side surface of the groove 17. Of course, the support frame 10 may not be provided with the groove 17. After the support layer 10 is attached with the transition layer 16 and the bundled steel wire, plates can be provided on both sides of a layer structure of the support frame 10, the transition layer 16, and the bundled steel wire and fix the layer structure. It is beautiful and avoids the displacement of the transition layer 16 and the bundled steel wire.

The bundled steel wire is wound on the transition layer 16 in the present disclosure, the stability of the transition layer 16 and the support frame 10 can provide a support frame for the bundled steel wire, preventing only the support frame 10 as the support frame. Therefore, the support frame 10 cannot be an integral structure and formed by a plurality of steel castings in a splicing manner. The plurality of steel castings can be spliced and the transition layer 16 is bound on the plurality of steel castings, forming a stable support after winding the bundled steel wires. Since the support frame 10 mainly provides a support for the device in the inner ring, the structure of the support frame 10 can be simplified by the transition layer 16 and the bundled steel wire, the support frame 10 can be manufactured more simply, the production requirements and material cost can be reduced, and resources can be saved.

The transition layer 16 is coated to the bottom surface of the groove 17, which not only provides a winding support frame for the bundled steel wire, but also has a frictional force ensuring that the steel plate will not slide during subsequent use and the winding of the bundled steel wire is stable. The upper surface of the transition layer 16 is non-smooth, and a friction force of the upper surface of the steel sheet layer will provide a large friction force for the bundled steel wire to improve the structural stability of the support frame after winding. Preferably, the lower surface of the transition layer 16 in contact with the bottom surface of the groove 17 is provided with a ridge, and the bottom surface of the groove 17 is provided with another groove coupled to the ridge. When the steel plate is matched with the bottom surface of the groove 17, the transition layer 16 is not displaced around the outer periphery, and the ridge can provide a resistance, and the upper surface of the transition layer 16 may also be provided with such a structure for increasing the friction or binding the bundled steel wire, thereby ensuring the stability and structural rigidity of the frame structure and reducing the possibility of deformation of the support frame.

In the oil hydraulic press 100 provided by the present disclosure, the main cylinder assembly 20 and the fixed die table 30 can be fixed by the support frame 10, which forms a ring-like structure, can be operated in one, two or multiple sets in parallel and all can realize pressing manufacture. The oil hydraulic press 100 has less components, reduced material consumption and low manufacturing cost.

It will be readily understood by those skilled in the art that the above various preferred embodiments can be freely combined and superimposed without conflict.

It is to be understood that the above-described embodiments are merely illustrative and not restrictive. Various obvious or equivalent modifications or alterations to the above-described details will be included in the scope of the claims of the present disclosure without departing from the basic principles of the application.

I claim:

1. An oil hydraulic press comprising a support frame, at least two main cylinder assemblies, two first fixed die tables and at least one pair of two second fixed die tables disposed in and fixed by the support frame, each of the at least two main cylinder assemblies comprises a cylinder body and first and second pistons respectively disposed on two ends of the cylinder body, the first and second pistons are arranged coaxially and move in opposite directions driven by the cylinder body, each of the at least two main cylinder assemblies is coaxially arranged in a line along a telescopic direction of the first and second pistons, the support frame comprises two sets of end frames and at least one set of intermediate frames disposed between the two sets of end frames, each of the two sets of end frames comprises two first buckle frames coupled to each other, the two first buckle frames are symmetrically arranged around a moving shaft of the respective first piston, one end of each of the two first buckle frames carries the cylinder body of an adjacent main cylinder assembly, the other end of each of the two first buckle frames carries one of the two first fixed die tables, the at least one set of intermediate frames comprises two second buckle frames, the two second buckle frames are symmetrically arranged around moving shafts of the second pistons, and two ends of each of the two second buckle frames are respectively connected to the adjacent cylinder bodies, the at least one pair of two second fixed die tables connecting with the at least one set of intermediate frames is disposed between the at least two main cylinder assemblies, the at least one pair of two second fixed die tables comprises two second fixed die tables opposite to each other, and the at least two main cylinder assemblies cooperate with the two first fixed die tables and the at least one pair of two second fixed die tables respectively, resulting in forming a plurality of pressing mechanisms which are mutually coaxial.

2. The oil hydraulic press of claim 1, wherein each of the two first buckle frames comprises a main segment and a bending segment, the main segment and the bending segment are curved, and a curvature of the main segment is smaller than that of the bending segment, one end of the main segment is connected with the cylinder body of the adjacent main cylinder assembly, and the other end of the main segment is connected with one end of the bending segment, the one end of the main segment connected to the cylinder body is provided with a groove, and the corresponding cylinder body is provided with a protrusion that cooperates with the groove.

3. The oil hydraulic press of claim 2, wherein the bending segment of each of the two first buckle frames are interconnected and form a connection surface at a joint, which is coplanar with the moving shafts of the first and second pistons.

* * * * *